United States Patent [19]

Erismann et al.

[11] Patent Number: 4,783,185

[45] Date of Patent: Nov. 8, 1988

[54] PEN-LIKE DISPENSER FOR APPLYING RUST CONVERTING LIQUID

[75] Inventors: David W. Erismann, Cottage Grove; David F. Serino, Maplewood; Mark D. Sorlien, White Bear Lake, all of Minn.

[73] Assignee: Minnesota Mining and Manufacturing Company, St. Paul, Minn.

[21] Appl. No.: 882,255

[22] Filed: Jul. 7, 1986

[51] Int. Cl.[4] ..... A47L 13/34; A47L 13/03

[52] U.S. Cl. ..... 401/37; 401/118; 401/195; 401/262; 401/264

[58] Field of Search ..... 401/260, 264, 139, 126, 401/118, 262, 195, 37

[56] References Cited

U.S. PATENT DOCUMENTS

| | | | |
|---|---|---|---|
| 2,714,475 | 8/1955 | Roehrich | 401/260 X |
| 3,011,499 | 12/1961 | Tajan | 401/139 |
| 3,378,330 | 4/1968 | Schwartzman | 401/260 |
| 3,680,968 | 8/1972 | Schwartzman et al. | 401/260 |
| 3,782,600 | 1/1974 | Columbus | 401/139 X |
| 4,461,408 | 7/1984 | Shepard | 401/260 X |
| 4,541,552 | 9/1985 | Scheithauer | 401/264 X |

FOREIGN PATENT DOCUMENTS

| | | | |
|---|---|---|---|
| 2922044 | 12/1979 | Fed. Rep. of Germany | 401/139 |
| 358031 | 12/1961 | Switzerland | 401/118 |
| 2068217 | 8/1981 | United Kingdom | 401/126 |

*Primary Examiner*—Steven A. Bratlie

*Attorney, Agent, or Firm*—Donald M. Sell; William L. Huebsch

[57] ABSTRACT

A pen-like dispenser for applying rust converting liquid including a cap having an outer abrading surface adapted to scrape loose paint and rust from a surface to which the liquid is to be applied; and a liquid dispensing part including an elongate fluid reservoir having resiliently flexible walls, and a dispensing tip assembly. The tip assembly includes a valve member normally closing the tip assembly and having a tip projecting through an outlet passageway through the housing under the influence of a spring. The valve member may be moved to an open position by pressing its tip against a rusted substrate to afford outflow of the liquid, which flow can be controlled and aided by pressing inwardly on the flexible walls of the reservoir.

2 Claims, 1 Drawing Sheet

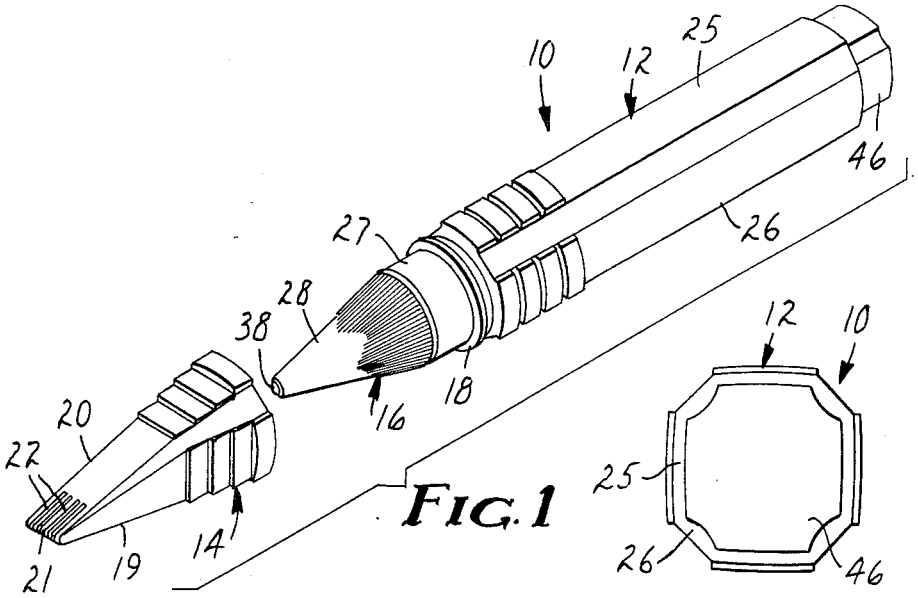
FIG. 1
FIG. 2
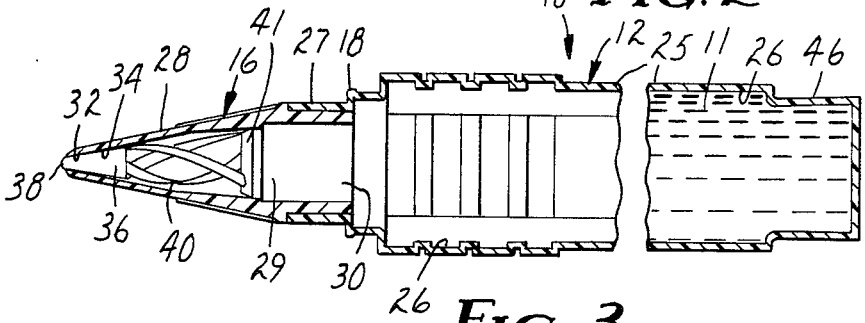
FIG. 3
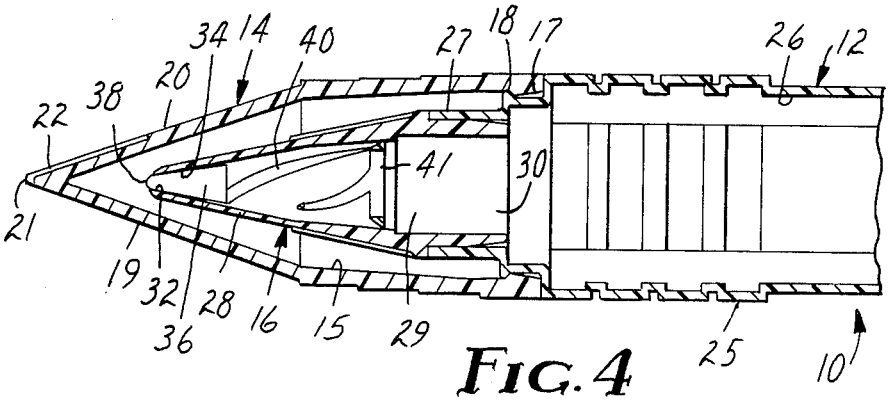
FIG. 4

PEN-LIKE DISPENSER FOR APPLYING RUST CONVERTING LIQUID

TECHNICAL FIELD

The present invention relates to dispensers for rust converting liquids.

BACKGROUND ART

Dispensers for rust converting liquids such as those sold under the trade designation "Duro Extend" by Loctite Corporation, Newington, Conn. or "Rust Reformer" by Rust-Oleum, Elk Grove Village, Ill. have heretofore comprised plastic bottles with a manually openable valve in a cap for the bottle through which the liquid can be dispensed; and the use of such dispenser has involved opening the valve, dispensing a quantity of the liquid into a container (which container may be provided as a removable cover over the cap of the container), and then applying the liquid from the container to a rusted surface from which loose rust has been scratched away. Such application of rust converting liquid has thus required the use of a rust removal implement (such as a scraper or wire brush) and a liquid application implement (such as a paint brush); often results in wasting the rust converting liquid since excess liquid dispensed into the container should not be returned to the bottle since it could contaminate the liquid in the bottle; and requires subsequent clean up of the application implement and container if they are to be saved.

DISCLOSURE OF THE INVENTION

The present invention provides a dispenser for rust converting liquids which affords use and application of only the needed amount of the rust converting liquid without the need for separate rust removing and liquid applying implements or the need for substantial clean up after the liquid is applied.

According to the present invention there is provided a pen-like dispenser for applying rust converting liquid, which dispenser comprises a liquid dispensing part, and a cap adapted to releasably engage the dispensing part. The cap has an outer abrading surface adapted to scrape loose paint and rust from a surface to which rust converting liquid is to be applied. The liquid dispensing part comprises resiliently flexible walls of polymeric material defining an elongate fluid reservoir containing a quantity of the rust converting liquid, and a polymeric dispensing tip assembly including a housing attached to the reservoir with a passageway through the housing communicating with an opening into the reservoir. A valve member within the housing has a periphery adapted for sealing engagement with a wall defining a portion of the passageway adjacent its outlet end and a tip adapted to project through the outlet end of the passageway when the valve member is in sealing engagement with that wall, and biasing means are provided for biasing the valve member into sealing engagement with the wall defining the passageway portion while affording movement of the valve member to an open position spaced from the wall defining the passageway portion so that the rust converting liquid may pass. The valve member may be moved to its open position by pressing its tip against a substrate to which rust converting liquid is to be applied, and the movement of the rust converting liquid past the open valve member may be aided by pressing inwardly on the flexible walls defining the reservoir. After a desired amount of the liquid is applied, the dispenser is moved away from the substrate so that the valve member again seals the liquid in the dispenser, and the cap may be engaged with the dispensing part so that a socket in the cap receives and protects the dispensing tip assembly.

Thus, the pen-like dispenser provides all that is needed to remove loose rust and apply the liquid without the need for other implements such as scrapers and brushes, only the liquid needed to coat the surface is dispensed from the device, and a minimum of cleanup is required.

Preferably, the cap of the pen-like structure is of polymeric material and the abrading surface on the cap by which loose paint and rust are removed includes a generally planar side surface portion leading to a generally linear edge surface portion, which surface portions are grooved in a direction perpendicular to the edge surface portion so that the abrading surface may be moved back and forth in directions at right angles to the grooves as it is pressed against and advanced over a rusted area to be cleaned in a direction perpendicular to the edge surface portion whereupon the abrading surface works somewhat like a file and scraper to remove the loose paint and rust.

BRIEF DESCRIPTION OF THE DRAWING

The present invention will be further described with reference to the accompanying drawing where like reference numerals refer to like parts in the several views, and wherein:

FIG. 1 is a perspective view of a pen-like dispenser for applying rust converting liquids according to the present invention shown with a dispensing part and a cap for the dispenser separated;

FIG. 2 is an end view of the dispenser of FIG. 1;

FIG. 3 is a fragmentary enlarged longitudinal cross sectional view of the pen-like dispenser of FIG. 1 with a cap for the device removed; and FIG. 4 is an enlarged fragmentary longitudinal cross sectional view of the pen-like dispenser of FIG. 1 shown with its cap engaged with its dispensing part.

DETAILED DESCRIPTION

Referring now to the drawing, there is shown a pen-like dispenser for applying a rust converting liquid 11 according to the present invention generally designated by the reference numeral 10.

Generally, the dispenser 10 comprises a dispensing part 12 for use in applying the liquid 11 (shown only in a portion of FIG. 3), and a cap 14 having a socket 15 adapted to receive a liquid dispensing tip assembly 16 on the dispensing part 12 and adapted to releasably engage the dispensing part 12 with the tip assembly 16 in the socket 15 by resilient engagement of a flexible inwardly projecting lip 17 on the cap over an outwardly projecting ridge 18 on the dispensing part 12.

The cap 14 has generally rectangular planar outer side surface portions 19 and 20 disposed at an acute angle (e.g., about 40 degrees) that meet at an edge surface portion 21. The cap 14 has a plurality of parallel spaced grooves 22 in the planar side surface portion 20 and the edge surface portion 21, which grooves extend in a direction perpendicular to the edge surface portion 21 to provide an abrading surface that can be moved back and forth in directions parallel to the edge surface portion 21 with the abrading surface pressed against loose paint and rust as it is advanced over the area of loose paint and rust to be cleaned so that the abrading surface will remove the loose paint and rust.

The dispensing part 12 comprises resiliently flexible walls 25 of polymeric material (e.g., in the range of about 0.020 to 0.050 inch thick high density polyethylene) defining an elongate fluid reservoir 26 having an opening at a first end 27.

A quantity of the rust converting liquid 11 (shown only in a portion of FIG. 3) is contained in the reservoir 26 and is retained therein by the dispensing tip assembly 16 which is a commercially available assembly (i.e., the "Eaton Allen TM Housing Assembly" available from Dab-O-Matic, Mount Vernon, N.Y.) of abrasion resistant polymeric material (e.g., acetal). The tip assembly 16 includes a housing 28 having a through passageway 29 between inlet and outlet ends 30 and 32 and is attached to the reservoir 26 around the inner surface of its opening by being press fit therein or by using a suitable adhesive with the inlet end 30 of the passageway 29 communicating with the opening into the reservior 26. The housing 28 of the tip assembly 16 defines a generally cylindrically conical passageway portion 34 adjacent its outlet end 32. A generally conical valve member 36 is disposed within the housing 28 and has a conical periphery adapted for sealing engagement with the conical passageway portion 34 and a tip 38 adapted to project through the outlet end 32 of the passageway 29 when the periphery of the valve member 36 is in sealing engagement with the conical passageway portion 34. Biasing means in the form of a helical polymeric spring 40 supported at its end opposite the valve member 36 by a ring 41 fixed to the housing 28 is included for biasing the valve member 36 to place the periphery of the valve member 36 in sealing engagement with the conical passageway portion 34 while affording movement of the valve member 36 to an open position spaced from the conical passageway portion 34 in opposition to the spring 40. The valve member 36 may be moved to its open position by pressing the tip 38 of the valve member 36 against a substrate to which rust converting liquid is to be applied.

The rust converting liquid 11 to be dispensed by the dispenser is of the known type containing one or a mixture of polyhydroxyaromatic compounds such as trihydroxybenzene or tannic acid which react with iron salts to form an organometallic complex, preferably in an aqueous solution. Additionally the liquid should include a film forming agent (e.g., Haloflex 202 available from ICI America, Wilmington, Del.) which helps the liquid form a moisture resistant coating, a surfactant (e.g., Dowfax 2Al available from Dow Chemical Company, Midland, Mich.) which helps the liquid flow and penetrate rust; a thickening agent (e.g., xanthan gum or fumed silica) which provides a desired viscosity of about 500–1000 centipose; and a coalescing agent (e.g., alkyl glycol ethers) which will help to reduce the minimum temperature at which particles in the aqueous solution will fuse and form a film as the liquid dries. Rust converting liquids available from Loctite Corporation, Newington, Conn. or Rust-Oleum, Elk Grove Village, Ill., can be used in the dispenser 10, however, the viscosity of these products should, if necessary, be adjusted into the 500–1000 centipoise range for ease of dispensing.

To use the dispenser 10, a person first presses the abrading surface on the cap 14 against a rusted surface to be treated and can move the abrading surface back and forth in directions at right angles to the grooves 22 as it is advanced along the rusted surface in a direction perpendicular to the edge surface portion 21 so that it works somewhat like a scraper and a file to remove loose paint and rust from the rusted area. Such preparation of the rusted area can be done with the cap 14 attached to the liquid dispensing part 12. The cap 14 is then removed from the dispensing part 12, and may be frictionally engaged over a reduced end portion 46 of the reservoir 26 from whence its abrading surface can again be used to scrape loose paint or rust from the rusted area, should that be needed. The tip 38 of the valve member 36 is then pressed against the rusted area so that the valve member 36 is moved to its open position against the bias of the spring 40 and the rust converting liquid 11 can flow past the open valve member 36. Such flow of the liquid 11 can be aided and controlled by pressing inwardly on the flexible walls 25 of the reservoir 26, and the tip 38 can be moved around the rusted surface as needed until the rusted surface is completely coated with the liquid 11. After a desired amount of liquid is applied, the dispenser 10 is moved away from the treated surface so that the valve member 36 again seals the liquid 11 in the dispenser, and the cap 14 may again be engaged with the dispensing part 12 so that the socket 15 in the cap 14 receives and protects the dispensing tip assembly 16.

The present invention has now been described with reference to one embodiment thereof. It will be apparent to those skilled in the art that many changes can be made in the embodiment described without departing from the scope of the present invention. For example, the abrading surface could be formed on the dispensing part of the dispenser. Thus the scope of the present invention should not be limited to the structures described in this application, but only by structures described by the language of the claims and the equivalents of those structures.

We claim:

1. A pen-like dispenser for applying rust converting liquid, said dispenser comprising:

a fluid reservoir having a first end, comprising resiliently flexible walls of polymeric material and having an opening at said first end; p1 a quantity of rust converting liquid in said reservoir;

a polymeric liquid dispensing tip assembly including a housing having a through passageway between inlet and outlet ends and attached to said reservoir around said opening with said inlet end communicating with said opening, said housing including a wall defining a passageway portion adjacent said outlet end; a valve member within said passageway having a periphery adapted for sealing engagement with said wall defining said passageway portion and a tip adapted to project through said outlet end of said passageway when the periphery of said valve member is in sealing engagement with said wall defining said passageway portion, and biasing means for biasing said valve member to place the periphery of said valve member in sealing engagement with said wall defining said passageway portion while affording movement of said valve member to an open position spaced from said wall defining said passageway portion in opposition to said biasing means to afford movement of said liquid through said passageway, to which open position said valve member may be moved by pressing the tip of said valve member against a substrate to which rust converting liquid is to be applied; and an outer abrading surface adapted to scrape loose paint and rust from a surface to which rust converting liquid is to be applied by said dispensing part, said abrading surface including a planar surface portion and a generally linear edge surface portion, and spaced parallel grooves along said planar and edge surface portions at generally a right angle to said edge surface portion.

2. A pen-like dispenser for applying rust converting liquid, said dispenser comprising:

a dispensing part comprising:

a fluid reservoir having a first end, comprising resiliently flexible walls of polymeric material and having an opening at said first end;

a quantity of rust converting liquid in said reservoir; and a polymeric liquid dispensing tip assembly including a housing having a through passageway between inlet and outlet ends and attached to said reservoir around said opening with said inlet end communicating with said opening, said housing including a wall defining a passageway portion adjacent said outlet end; a valve member within said passageway having a periphery adapted for sealing engagement with said wall defining said passageway portion and a tip adapted to project through said outlet end of said passageway when the periphery of said valve member is in sealing engagement with said wall defining said passageway portion, and biasing means for biasing said valve member to place the periphery of said valve member in sealing engagement with said wall defining said passageway portion while affording movement of said valve member to an open position spaced from said wall defining said passageway portion in opposition to said biasing means to afford movement of said liquid through said passageway, to which open position said valve member may be moved by pressing the tip of said valve member against a substrate to which the rust converting liquid is to be applied; and a cap of polymeric material having a socket adapted to receive said tip assembly and adapted to releasably engage said dispensing part with said tip assembly in said socket, said cap having an outer abrading surface adapted to scrape loose paint and rust from a surface to which rust converting liquid is to be applied by said dispensing part, said abrading surface including a planar surface portion and a generally linear edge surface portion, and spaced parallel grooves along said planar and linear edge surface portions at generally a right angle to said edge surface portion.

* * * * *